United States Patent [19]

Pisani

[11] 4,406,233

[45] Sep. 27, 1983

[54] APPARATUS FOR CONVERTING WEB MATERIAL INTO TUBULAR FORM

[75] Inventor: Luigi Pisani, Cilavegna, Italy

[73] Assignee: Rockwell International Corporation, Pittsburgh, Pa.

[21] Appl. No.: 450,939

[22] Filed: Dec. 20, 1982

[30] Foreign Application Priority Data

Apr. 6, 1982 [IT] Italy ..... 20605 A/82

[51] Int. Cl.[3] ..... D05B 23/00

[52] U.S. Cl. ..... 112/63; 112/10

[58] Field of Search ..... 112/63, 10, 11, 2

[56] References Cited

U.S. PATENT DOCUMENTS

| | | | |
|---|---|---|---|
| 2,321,010 | 6/1943 | Cohn | 112/63 X |
| 2,753,823 | 7/1956 | Judelson | 112/63 X |
| 2,900,934 | 8/1959 | Judelson | 112/63 |
| 3,759,198 | 9/1973 | Pisani | 112/63 |
| 4,370,936 | 2/1983 | Moyer et al. | 112/10 |

FOREIGN PATENT DOCUMENTS

| | | | |
|---|---|---|---|
| 2448976 | 10/1980 | France | 112/10 |
| 652961 | 5/1951 | United Kingdom | 112/63 |

*Primary Examiner*—H. Hampton Hunter

[57] ABSTRACT

A sewing unit for withdrawing web material, of the knitted type, from a source, folding it and then seaming one side to place it in tubular form. The apparatus includes a triangle unit for folding the web material as it is received from its source and then advancing it into operative association with a tentering member about which it extends. From the tentering member the folded material is advanced to the sewing zone of a sewing machine and then advanced to a position whereat the tubular material is wound onto a take-up roll. An elongated bar member being selectively adjustable relative to positions inclined from a horizontal plane is adapted to engage and raise the lowermost portion of the folded material whereby it is caused to be displaced toward the machines line of sewing.

6 Claims, 3 Drawing Figures

APPARATUS FOR CONVERTING WEB MATERIAL INTO TUBULAR FORM

BACKGROUND OF THE INVENTION

1. Field of the Invention

The present invention pertains to a sewing unit for withdrawing knit fabric, such as jersey, from a supply roll thence advancing it to a position for folding the fabric and thence guiding the folded fabric to the sewing zone of a sewing machine whereat it is seamed along one edge so as to place it in tubular form. From the sewing zone the tubular fabric is advanced to a position whereat it is fed and wound onto a take-up roll. More especially, the apparatus, according to the invention, serves to maintain adequate control of the folded jersey material during seaming which, as known by those conversant in the art, is difficult to advance along a desired pathway as well as to maintain the edges aligned when folded, all of which can be attributed to the material's flaccid, stretchable and slidable characteristics.

2. Description of the Prior Art

Devices are well known that utilize triangle members for folding web material drawn from a supply roll and then feeding the folded material to the sewing zone of a sewing machine whereat it is put into tubular form by the formation of a seam along one side thereof.

Devices are well known that utilize triangle members for folding web material drawn from a supply roll and then feeding the folded material to the sewing zone of a sewing machine to convert it into tubular form and then winding the latter onto take-up rolls. One such known device is shown and described in Italian Pat. No. 931,034; however, such devices are not adapted to satisfactorily accommodate materials such as jersey having the characteristics described above. The known devices for performing this function tend to create high tractional forces on the fabric and the buildup of tension in the latter causes it to move away from the sewing zone during the seaming operation. This results in the formation of an unsatisfactory seam wherein a portion of the fabric at the side of the seam fails to be held at a constant width or the result is simply that certain portions fail to have a seam formed therein.

An object of the invention is to provide an apparatus that will overcome the disadvantages of the known devices when converting jersey web material or the like into tubular form. A further object is that of providing an apparatus which causes a slackening of the fabric prior to seaming whereby built up tension is removed and it enters the sewing zone in this manner.

SUMMARY OF THE INVENTION

The apparatus according to the invention includes a bar member mounted at a slight inclination to the horizontal and includes means for selectively changing its setting to a desired angle of inclination. This bar serves to engage and raise the lower portion of fabric, which extends about a tentering device parallel to the line of sewing and upwardly to a take-up roll for receiving the sewn fabric, in a manner whereby the tentering device becomes elevated relative to the table of the sewing machine, by the tension in the fabric in contact therewith and results in a sliding movement of the folded fabric in the direction of the line of sewing.

Additionally, the apparatus is provided with a support member adjustably mounted relative to the line of sewing on the table and includes a support block attached thereto for the bar member which can be rotatably adjusted so as to obtain the desired angle of inclination of the bar member.

One end of the tentering device is fixedly attached to the table and the other end is capable of being flexed upwardly as well as being selectively positioned so as to regulate the distance intermediate the tentering device and the line of sewing.

Forwardly and rearwardly of the sewing zone separating devices are provided for maintaining the edges of the fabric separated until they reach the turning over device which is effective in folding the edges of each portion outwardly of the seam in opposing directions.

The rollers for advancing the folded fabric leaving the triangle unit are operatively connected to the rollers for winding the sewn fabric in a manner whereby the velocities of rotation of both sets of rollers are equal to each other.

Other objects and advantages of the invention will become more fully apparent by reference to the appended claims and as the following detailed description proceeds in reference to the figures of drawings wherein:

DESCRIPTION OF THE PREFERRED EMBODIMENT

Figure 2:
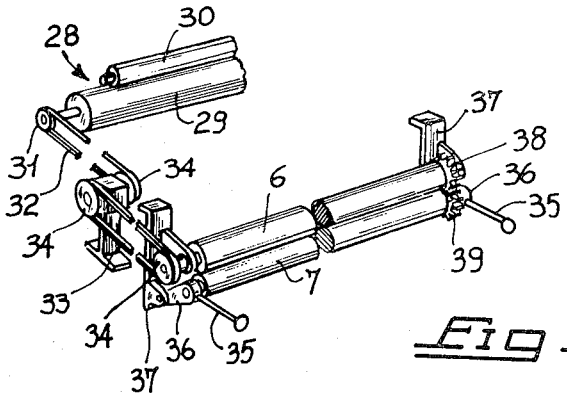
FIG. 2 is a perspective view of the fabric delivery and take-up rollers associated with the invention.
Figure 1:
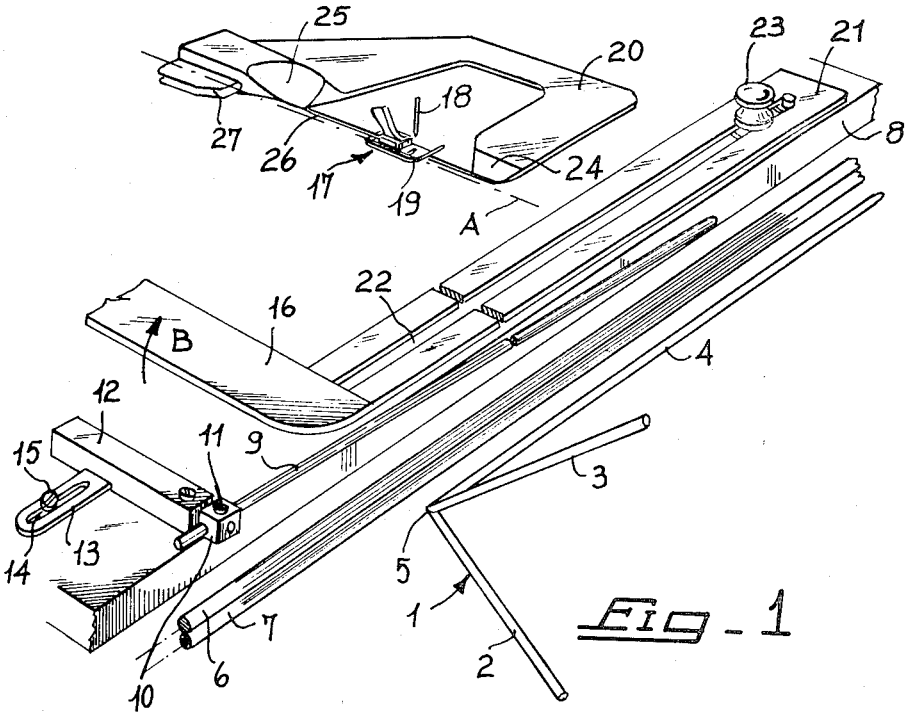
FIG. 1 is a perspective view of a portion of a sewing machine showing the apparatus according to the invention operatively associated therewith.

Referring now to FIG. 1, a known form of folding triangle is identified generally by numeral 1 and comprises a lower side 2, an upper side 3 and a stiffening rod 4 all of which join at a vertex 5 disposed adjacent a pair of feed rollers 6 and 7 that extend parallel with the stiffening rod 4.

The fabric T prior to being folded is withdrawn from a supply roll (not shown), as described in Italian Pat. No. 931,034, and then caused to slide over the sides 2 and 3 where it is folded. Upon leaving the folding triangle 1, the folded fabric is caused to pass between the two rotatably driven feed rollers 6 and 7.

The apparatus includes a table identified by numeral 8 and a bar member 9 that extends along one side of the table at an angle inclined to the upper planar surface of the latter. The bar member is mounted in a block 10 by means of a set screw 11. Block 10 is mounted for selective rotatable positioning on a support bar 12 that is provided with an integral mounting plate 13. This mounting plate 13 is provided with a slot 14 which is adapted to receive a screw 15 for attaching the support bar 12 to the table 8.

When the folded fabric T leaves the rollers 6 and 7, it is caused to pass over the bar member 9 and is then fed onto a tentering device 16 in a manner whereby the fabric is folded about it. This tentering device extends parallel to a line of sewing that is identified by the letter A in the sewing zone that is depicted generally in FIG. 1 by numeral 17. This sewing zone shows only those parts of a sewing machine which are considered necessary for a complete understanding of the invention and includes a needle 18, presserfoot 19 and a workpiece guide 20.

The tentering device 16 is attached to one end of an elongated flexible support 21 which is provided with a longitudinal slot 22 that serves as a means for its attachment to the table 8 by means of a threaded knob 23 and as a means for selectively varying the distance thereof from the line A of sewing.

The position of the tentering device 16 is adjusted in accordance with the dimensions of the fabric so that when the latter is folded about the tentering device, the superposed edge portions are joined at the sewing zone so as to leave a border externally of the actual seam.

The inclination of the bar member 9 can be regulated by selectively rotating the block 10 carried by the support bar 12. The support bar 12 can be adjustably positioned with respect to the tentering device 16 in such a manner that the lower portion of the fabric T folded about the tentering device 16 is raised by the bar member 9. Bar member 9 has an inclination such that the flexibly mounted tentering device 16 is caused to be raised from the table 8 in the direction of arrow B (FIG. 1) as a result of the tension buildup in the folded fabric T and is effective in causing displacement of the actual fabric in the direction of the line A of sewing.

The effect of such displacement is that the fabric prior to being sewn becomes arcuated and slackened until it returns to its original state free of tension.

Figure 3:
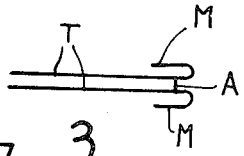
FIG. 3 is a diagrammatic view of the fabric after having been seamed.

The workpiece guide is identified by numeral 20 and is provided with separating elements 24 and 25 and with an edge 26 which serves to maintain the portions M of the fabric (FIG. 3) separated until they reach the turnover member 27 which folds these portions which are disposed externally of the seam inwardly in opposing directions.

After the fabric has been folded and sewn into tubular form, it is advanced to a take-up mechanism identified generally by numeral 28 which comprises a winding roller 29 and a take-up roller 30 onto which the sewn fabric is wound.

The winding roller 29 has a drive pulley 31 fixed on one end thereof and is operatively connected to the feed roller 6 by means of two drive belts 32 and 33 connected to pulleys 34 of identical diameter to that of pulley 31 whereby the same velocity of rotation between the feed roller 6 and the winding roller 29 is provided.

The folded fabric presented by the folding triangle 1 is inserted betweem the feed rollers 6 and 7 by displacing the lower roller 7 downwardly by means of handles 35 fixed to a movable support 36 pivoted on fixed supports 37 which carry the roller 6.

Between the fixed and movable supports 37, 36, a spring (not shown) is inserted and provides the means for effecting positive meshing engagement of gear members 38 and 39 that are fixed on one end of rollers 6 and 7 respectively.

A suitable drive motor (not shown) is operatively connected to the feed roller 6 and its motion is trasmitted both to the feed roller 7 to effect advance of unfolded fabric and to the winding roller 29 by means of the drive belts 32 and 33 so as to provide for take-up of the fabric sewn into tubular form.

Although the present invention has been described in connection with a preferred embodiment, it is to be understood that mofifications and variations may be resorted to without departing from the spirit and scope of the invention as those skilled in the art will readily understand. Such modifications and variations are considered to be within the purview and scope of the invention and the appended claims.

I claim:

1. An apparatus for converting web material drawn from a supply roll into tubular form in a sewing unit of the type having a folding triangle and a table with a sewing machine mounted thereon which includes a stitch forming needle and presserfoot defining the sewing zone and line of sewing, said apparatus comprising:

(a) a pair of feed rollers attached to one side of the table for receiving and advancing the material folded by the folding triangle;

(b) a tentering device mounted for flexing movement on the table in spaced and parallel ralation to the line of sewing for receiving the folded fabric thereon from said feed rollers;

(c) take-up means spaced from and operatively connected to said feed rollers for receiving the sewn fabric from the sewing zone; and (d) means mounted on the table adjacent said tentering device for releasing the tension buildup in the fabric extending between said feed rollers and take-up means and for effective displacement of the folded fabric in the direction of the line of sewing.

2. The apparatus according to claim 1, wherein said tentering device is fixed on one end of an elongated flexible support (21) including:

(i) means for selectively varying the distance between the tentering device and the line of sewing.

3. The apparatus according to claim 1, wherein said take-up means defines a winding roller (30) and take-up roller (29) including:

(i) drive means operatively interconnecting the winding roller with said feed rollers (6, 7) to effect the same velocity of rotation thereof.

4. The apparatus according to claim 1, wherein said releasing and displacement means defines a bar member (9) extending along one side of the table at a preselected angle of inclination relative to the supporting surface of the table.

5. The apparatus according to claim 4, wherein said bar member (9) includes means for selectively changing the angle of inclination at which it extends along the table.

6. The apparatus according to claim 1, wherein the sewing zone includes a workpiece guide (20) including:

(i) means (24, 25) forwardly and rearwardly of the sewing zone for maintaining separation of the edges of the fabric externally of the seam; and (ii) means (27) downstream of said separation means for folding each edge of the sewn fabric outwardly of the seam in opposed directions.

* * * * *